US006814818B2

(12) United States Patent
Woodfield et al.

(10) Patent No.: US 6,814,818 B2
(45) Date of Patent: Nov. 9, 2004

(54) HEAT TREATMENT OF TITANIUM-ALLOY ARTICLES TO LIMIT ALPHA CASE FORMATION

(75) Inventors: Andrew Philip Woodfield, Madeira, OH (US); Thomas Froats Broderick, Springboro, OH (US); Reed Roeder Corderman, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 179 days.

(21) Appl. No.: 10/286,241

(22) Filed: Oct. 30, 2002

(65) Prior Publication Data

US 2004/0084117 A1 May 6, 2004

(51) Int. Cl.[7] ..... C22C 14/00
(52) U.S. Cl. ..... 148/501; 148/669
(58) Field of Search ..... 420/417–421; 148/421, 668–671, 501

(56) References Cited

U.S. PATENT DOCUMENTS 4,528,043 A 7/1985 Mills 5,063,662 A 11/1991 Porter et al.

*Primary Examiner*—Deborah Yee
(74) *Attorney, Agent, or Firm*—McNees Wallace & Nurick LLC

(57) ABSTRACT

A method for heat treating titanium-alloy articles in a vacuum furnace includes a step of first determining, for a first set of titanium articles in a first vacuum furnace and for a first set of heat treatment conditions, a minimum surface area of the first set of titanium articles associated with an acceptable alpha case formation for the first set of titanium articles. There is a second determining, for a second set of titanium articles in a second vacuum furnace and for a second set of heat treatment conditions, of a minimum surface area of a second set of titanium articles associated with an acceptable alpha case formation for the second set of titanium articles, responsive to the value of the minimum surface area of the first set of titanium articles. There follows a heat treating of a third set of titanium articles in the second vacuum furnace and for the second set of heat treatment conditions, where the surface area of the third set of titanium articles is not less than the value of the minimum surface area of the second set of titanium articles.

19 Claims, 3 Drawing Sheets

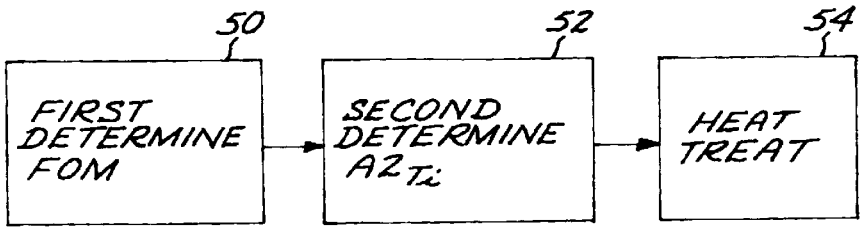
FIG. 3
FIG. 4
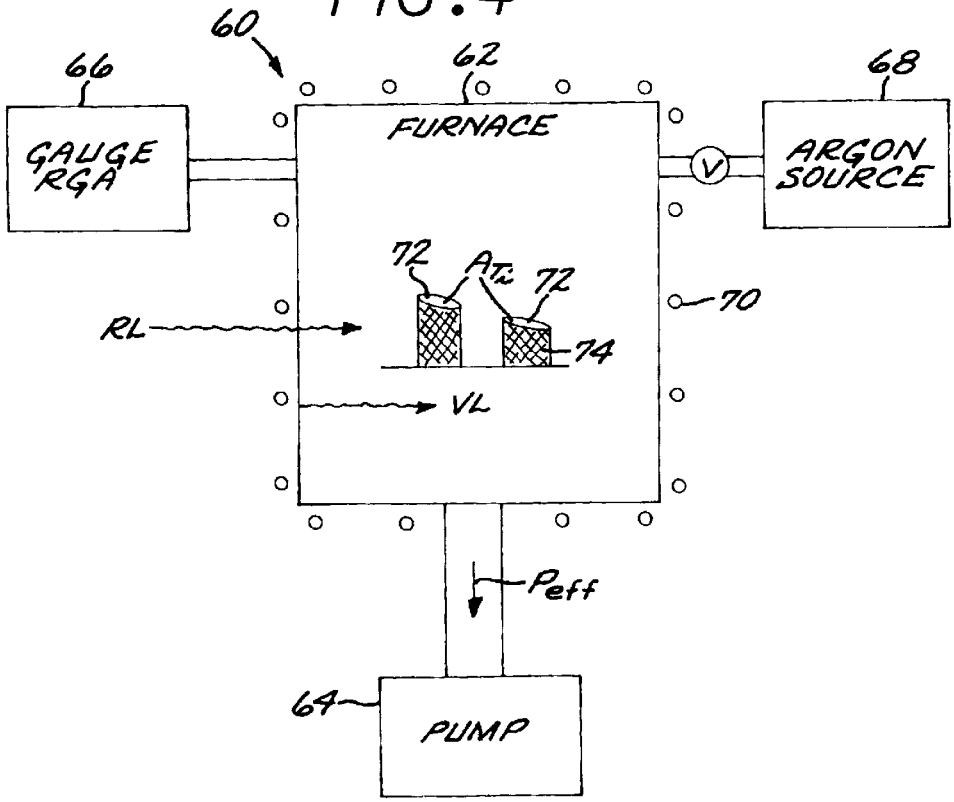

HEAT TREATMENT OF TITANIUM-ALLOY ARTICLES TO LIMIT ALPHA CASE FORMATION

This invention relates to titanium-alloy articles that are subject to alpha case formation and, more particularly, to the heat treatment of such articles to reduce the incidence of alpha case formation.

BACKGROUND OF THE INVENTION

Titanium-alloy articles may require heat treatment, after they are processed to substantially their final shapes and dimensions. For example, titanium-alloy gas turbine parts may require a final heat treatment to stress relieve the parts after forging, rejuvenation, or repair operations, or for mid-service stress relief.

Some titanium alloys, such as near-alpha, alpha, near-beta, beta, and alpha-beta titanium alloys, are subject to the formation of an alpha-embrittled zone at the surface of the article during heat treatment at a sufficiently high temperature and for a sufficiently long time in the presence of oxygen gas. The alpha-embrittled zone of oxygen-enriched alpha phase is generally termed an "alpha case". The alpha case is deleterious to the subsequent use of the article in some applications, because it has reduced fatigue resistance and increased susceptibility to impact damage, as compared with the underlying alpha-beta or other microstructure. When an alpha case is formed at the surface of a titanium-alloy gas turbine compressor blade, for example, it becomes susceptible to fatigue failure and also to impact failure by foreign objects ingested into the compressor.

The formation of alpha case limits the heat treatment of titanium alloys according to the composition of the alloy and the time and temperature of the heat treatment. As an example, the titanium alloy Ti-442 (Ti-4Al-4Mo-2Sn0.5Si) alloy is limited to a maximum heat treatment of about 1100° F. for 2 hours in vacuum in most circumstances by the formation of alpha case. For some processing methods now in development, higher temperatures and longer heat treatment times are required. However, if the heat treatment is at such higher temperatures or for longer times, an unacceptable thickness of alpha case forms. The alpha case may be removed by a chemical etching process, but the chemical etching is slow and adds substantially to the cost of the article. Chemical etching is not feasible for repairs or other situations where the part is already at its specified final dimension, because the chemical etching removes metal and may reduce the dimensions to below their acceptable range.

The heat-treating conditions that avoid the formation of an excessive alpha case on susceptible articles are known under some heat treatment conditions. However, it is difficult to extend the operable practices to other conditions. In a common example, experience has shown that researchers in the laboratory are often able to develop operable heat treatments to avoid the formation of excessive alpha case, but that these laboratory heat treatments cannot be successfully applied in many production settings. Similarly, operable practices developed for one production heat treatment furnace cannot be readily extended to another production heat treatment furnace.

There is therefore a need for an approach to limit the thickness of alpha case formation on titanium alloys having such a susceptibility that may be widely applied to different heat treatment conditions. The approach must be operable both for laboratory-scale work and also for production-scale operations. The present invention fulfills this need, and further provides related advantages.

SUMMARY OF THE INVENTION

The present approach provides a method for heating treating titanium-alloy articles that are susceptible to the formation of an alpha case. The method may be applied in both a laboratory and in a production environment in a manner that permits the laboratory results to be used in production heat treatment operations or procedures successful in one production setting to be applied in another production setting. The alpha case may be eliminated entirely, or it may be limited as needed consistent with other processing operations. The approach reliably produces the expected result.

A method for heat treating titanium-alloy articles comprises the steps of first determining, for a first set of titanium articles in a first vacuum furnace and for a first set of heat treatment conditions, a minimum surface area of the first set of titanium articles associated with an acceptable alpha case formation for the first set of titanium articles, and second determining, for a second set of titanium articles in a second vacuum furnace and for a second set of heat treatment conditions, a minimum surface area of a second set of titanium articles associated with an acceptable alpha case formation for the second set of titanium articles, responsive to the value of the minimum surface area of the first set of titanium articles. A third set of titanium articles is thereafter heat treated in the second vacuum furnace and for the second set of heat treatment conditions, where the surface area of the third set of titanium articles is not less than the value of the minimum surface area of the second set of titanium articles.

In a case of interest, the second vacuum furnace is different from the first vacuum furnace. That is, the first vacuum furnace may be a first production vacuum furnace, and the second vacuum furnace is a second production vacuum furnace. Or the first vacuum furnace may be a laboratory vacuum furnace, and the second vacuum furnace is a production vacuum furnace. Typically with this approach, the second set of heat treatment conditions is the same as the first set of heat treatment conditions.

The present approach desirably utilizes a figure of merit to determine the minimum surface areas of the sets of titanium articles. The preferred figure-of-merit approach incorporates an effective pumping rate of a vacuum furnace, a surface area of the set of titanium articles, a real leak rate of a vacuum furnace, and an outgassing leak rate of the vacuum furnace. A most preferred form of the figure of merit is $$FOM=(P_{eff}+K\cdot A_{Ti})/(RL+VL).$$

FOM is a figure of merit value, $P_{eff}$ is an effective pumping rate of a vacuum furnace, $K\cdot A_{Ti}$ is a self-pumping rate of the set of titanium articles in the vacuum furnace, K is a self-pumping constant, A is a surface area of the set of titanium articles, RL is a real leak rate of the vacuum furnace, and VL is an outgassing leak rate of the vacuum furnace. All of the pressures and rates are normally specified in terms of the oxygen partial pressure, but they may be expressed in terms of the total pressure if the percentage of oxygen stays constant as it does in the usual case when the only leaking and outgassing gas is air.

Thus, a method for heat treating titanium-alloy articles that are subject to the formation of an alpha case comprises the steps of first determining, for a first set of titanium articles in a first vacuum furnace and for a first set of heat treatment conditions, a value of FOM associated with an acceptable alpha case formation for the first set of titanium articles, for a relationship $$FOM=(P1_{eff}+K\cdot A1_{Ti})/(RL1+VL1),$$

wherein $P1_{eff}$ is an effective pumping rate, $K\cdot A1_{Ti}$ is a self-pumping rate of a first set of titanium articles, K is a self-pumping constant, A1 is a surface area of the first set of titanium articles, RL1 is a real leak rate, and VL1 is an outgassing leak rate. There is a second step of determining, for a second set of titanium articles in a second vacuum furnace and for a second set of heat treatment conditions, a value of $A2_{Ti}$ for a relationship $$A2_{Ti}=1/K[FOM\cdot(RL2+VL2)-P2_{eff}],$$

wherein $A2_{Ti}$ is a minimum permitted surface area of the second set of titanium articles, $P2_{eff}$ is an effective pumping rate, RL2 is a real leak rate, and VL2 is an outgassing leak rate. A third set of titanium articles is heat treated in the second vacuum furnace and for the second set of heat treatment conditions, where the surface area of the third set of titanium articles is not less than $A2_{Ti}$.

Typically but not necessarily, the second vacuum furnace is different from the first vacuum furnace, and the second set of heat treatment conditions is the same as the first set of heat treatment conditions.

In the usual approach, the step of first determining includes first measuring $P1_{eff}$, K, RL1, and VL1, and then determining FOM for the first vacuum furnace. The step of second determining then includes second measuring K, $P2_{eff}$, RL2, and VL2 for the second vacuum furnace, and then calculating $A2_{Ti}$ from these measurements and the FOM obtained from the step of first determining. The determination of FOM in the first determining step may be made either for a single point defining an acceptable alpha case thickness, or in a parametric fashion so that FOM is related to the surface areas of the different sets of titanium articles or other controllable variable.

The present approach provides a reliable technique for heat treating titanium-alloy articles that are otherwise susceptible to the formation of alpha case, and a tool for establishing heat treatments under various conditions. The approach allows the alpha case to be avoided entirely, or restricted in its formation to a selected value consistent with the required properties and/or with production techniques that may be applied to remove the alpha case. Successful procedures developed in one context may be extended, in a suitably modified form, to other contexts. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 3 is a block flow diagram of a method for practicing the invention;

FIG. 4 is a schematic depiction of a vacuum furnace; and

DETAILED DESCRIPTION OF THE INVENTION

Figure 1:
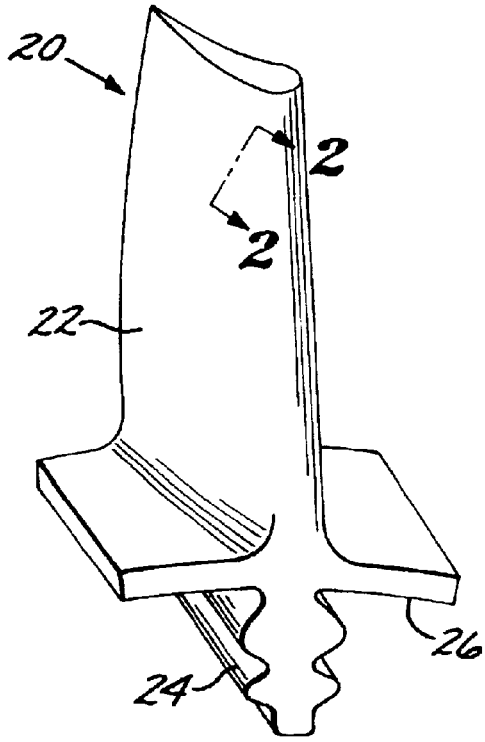
FIG. 1 is a perspective view of a titanium alloy compressor blade.

FIG. 1 depicts a component article of a gas compressor engine such as a compressor blade article or compressor vane article, and in this illustration a compressor blade 20. The compressor blade 20 is formed of any operable material, but is preferably a titanium-alloy composition that is susceptible to the formation of an alpha case, with an alpha-beta titanium alloy being most preferred. The compressor blade 20 includes an airfoil 22 against which the flow of air is directed. The compressor blade 20 is mounted to a compressor disk (not shown) by a dovetail 24 which extends downwardly from the airfoil 22 and engages a slot on the compressor disk. A platform 26 extends longitudinally outwardly from the area where the airfoil 22 is joined to the dovetail 24. The present approach is not limited to applications with compressor blades and vanes, but can also include disks to which blades are mounted, blisks, and other titanium articles as well.

Figure 2:
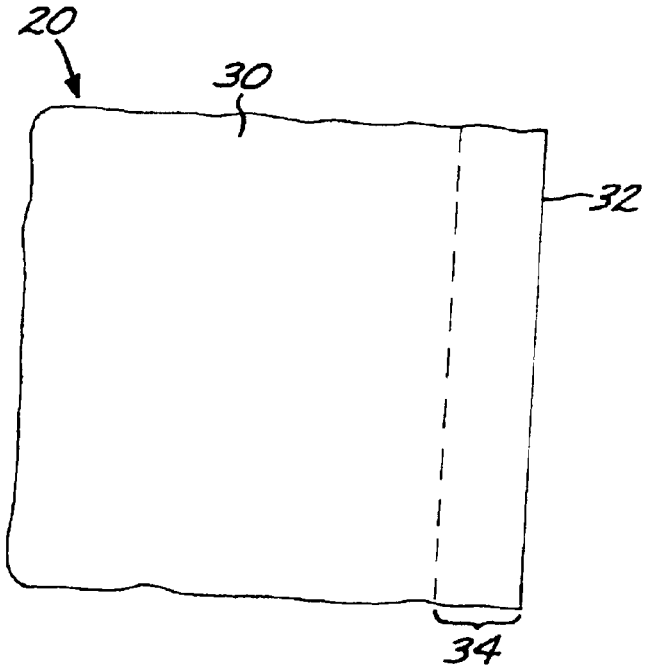
FIG. 2 is an enlarged sectional view of the compressor blade of FIG. 1, taken along line 2—2.

FIG. 2 is a section through the compressor blade article, whose body serves as a substrate 30 having a surface 32. Some alloys that are used to make the compressor blade are subject to the formation of an alpha case 34 extending inwardly from the surface 32 into the substrate 30. The alpha case 34 is a region, found just below the surface 32, that includes oxygen-enriched alpha phase of reduced ductility (as compared with non-oxygen-enriched alpha phase) as a result of oxygen diffusion inward from the surface 32. The thickness of the alpha case 34 is typically up to several thousandths of an inch, unless care is taken to avoid its formation or limit its thickness to an acceptable value (usually less than about 0.0005 inch thickness), or remove it after formation. The alpha phase that forms the alpha case is usually alpha phase that is initially present and into which oxygen diffuses from the surface 32 during the heat treatment. The oxygen-enriched alpha phase has reduced ductility relative to the remainder of the substrate 30. The oxygen-enriched alpha phase of the alpha case 34 therefore serves to reduce the fracture toughness of the article and to reduce its low-cycle fatigue life and its high-cycle fatigue life by promoting the formation of cracks at the surface of the article and their propagation. The maintaining of these properties is important to articles such as compressor blades and disks, and therefore the presence of even a thin layer of the alpha case 34 has a disproportionately deleterious effect on the properties of the article.

An example of an alloy that is subject to the formation of an alpha case 34 is a titanium alloy such as an alpha-beta titanium alloy. An alpha-beta titanium alloy is an alloy having more titanium than any other element, and which forms predominantly two phases, alpha phase and beta phase, upon heat treatment. In titanium alloys, alpha ($\alpha$) phase is a hexagonal close packed (HCP) phase thermodynamically stable at lower temperatures, beta ($\beta$) phase is a body centered cubic (BCC) phase thermodynamically stable at higher temperatures, and a mixture of alpha and beta phases (an alpha-beta titanium alloy) is thermodynamically stable at intermediate temperatures. An example of an alpha-beta titanium alloy used to make gas turbine compressor blades is Ti-442 (also sometimes known as Alloy 550), having a nominal composition in weight percent of Ti-4 percent Al-4 percent Mo-2 percent Sn-0.5 weight percent silicon. Some other titanium-base alloys susceptible to alpha case formation include alpha-beta or near-alpha alloys such as Ti-6Al-4V (sometimes known as Ti-64), Ti-6Al-2Sn4Zr-2Mo (sometimes known as Ti-6242), Ti-6Al-2Sn-4Zr-6Mo (sometimes known as Ti-6246), Ti-6Al-2Sn-2Zr-2Mo-2Cr-0.25Si (sometimes known as Ti-6-22-22S), Ti-5.8Al-4Sn-3.5Zr-0.7Nb-0.5Mo-0.35Si (sometimes known as Alloy 834), Ti-5Al-3.5Sn-3.0Zr-1Nb-0.3Si (sometimes known as Alloy 829), and Ti-5Al-4Mo-4Cr-2Sn-2Zr (sometimes known as Ti-17). The present invention may be utilized with any of these alloys. The use of the present invention is not limited to these alloys and may be used with other operable near-alpha, alpha, near-beta, beta, and alpha-beta titanium alloys that are susceptible to the formation of alpha case.

The alpha case 34 forms when oxygen diffuses from the surface 32 inwardly into the compressor blade article 20 during elevated temperature processing or heat treatment, even in the low oxygen partial pressure of a vacuum furnace. The formation of the alpha case 34 limits the heat treatment in production heat treating operations of susceptible alloys to a maximum combination of temperature and time. For Ti-442 alloy, for example, the maximum heat treatment conditions are about 1100° F. for 2 hours. The alpha case 34 may be removed after the heat treatment by chemical etching techniques or the like. However, such chemical removal techniques are expensive and time consuming, and may unacceptably reduce critical dimensions of the article. It is desirable that their use be avoided entirely or minimized to the removal of very thin alpha-case layers.

Higher heat treatment temperatures and times are required for advanced processing technologies. The use of these higher heat treatment temperatures and times is currently barred due to the formation of excessively thick layers of the alpha case in existing procedures, which are uneconomical to remove chemically.

FIG. 3 depicts a preferred approach for avoiding or minimizing the formation of alpha case 34 at the surfaces 32 of susceptible titanium alloys. It is based upon developing a figure of merit in one circumstance, and then applying the figure of merit in another circumstance. The preferred approach involves first determining a minimum surface area of a first set of titanium articles associated with an acceptable alpha case formation for the first set of titanium articles. In practice, the approach includes first determining, step 50, for a first set of titanium articles in a first vacuum furnace and for a first set of heat treatment conditions, a dimensionless value of FOM associated with an acceptable alpha case formation for the first set of titanium articles, for a relationship $$FOM=(P1_{eff}+K\,A1_{Ti})/(RL1+VL1).$$

$P1_{eff}$ is an effective pumping rate, $K{\cdot}A1_{Ti}$ is a self-pumping rate of a first set of titanium articles, K is a self-pumping constant, A1 is a surface area of the first set of titanium articles, RL1 is a real leak rate, and VL1 is an outgassing leak rate. All of the pressures and rates are preferably specified in terms of the oxygen partial pressure, but they may be expressed in terms of the total pressure if the percentage of oxygen stays constant as it does in the usual case when the only leaking and outgassing gas is air. Thus, in most practical cases, either oxygen partial pressure or total pressure may be used.

FIG. 4 schematically depicts a vacuum furnace 60 having a vacuum chamber 62 that is pumped by a vacuum pump 64 having its pumping speed $P_{eff}$. (Although strictly speaking most "vacuum furnaces" are actually vacuum ovens, the "vacuum furnace" terminology is widely used and will be utilized herein.) There is a total leak-up rate RL of the vacuum chamber 62 at its evacuated pressure of oxygen from the exterior through the various vacuum joints. The total outgassing leak rate VL at the evacuated pressure is due to outgassing from the structure within the vacuum chamber other than the articles being heat treated. The pressure within the vacuum chamber 62 is monitored by a vacuum gauge and residual gas analyzer (RGA) 66. A source of an high-purity, low oxygen inert gas, here indicated as an argon source 68, provides a controllable backfill into the vacuum chamber 62 as needed. The vacuum chamber 62 is heated by a heating source 70, here illustrated as electrical heater resistance coils. Within the vacuum chamber 62 are one or more articles 72 to be heat treated. The articles 72 have a total surface area of $A_{Ti}$. The articles 72 may optionally be wrapped in a getter material 74 such as titanium or tantalum foil. Titanium sponge or powder may also be placed in the vacuum chamber 62 as a getter material, but this is not preferred due to the increased difficulty in pumping the vacuum chamber 62.

In such a vacuum furnace 60 having its vacuum chamber 62, the effective pumping rate $P_{eff}$ is directly measured by connecting the measuring device directly to the pump and measuring the gas flow to the pump in convenient units. The real leak rate RL is the leakage rate into the vacuum chamber, and the outgassing leak rate VL is a result of the interior walls and other interior apparatus outgassing. These two quantities are difficult to measure separately, and in this case no separate measurement is necessary because only their sum is utilized. The sum of the real leak rate and the outgassing leak rate is measured by pumping out the vacuum chamber when it is empty, closing the gate valve, observing the change in vacuum pressure, and calculating the leak rate in the same units.

The self-pumping (or gettering) rate at which oxygen is absorbed into the articles ($K{\cdot}A1_{Ti}$ in the relation above) is a constant times the surface area of the articles. The value of the constant K is determined by measuring the decrease in the leak-up rate as a function of the furnace loading, where the furnace loading is simply the area of the articles in the furnace that are to be heat treated. To perform this measurement, the heat treatment is performed several times, with different amounts of surface area of the articles to be heat treated in each of the several repetitions. The value of K is expected to be a constant for any selected material of construction of the articles being heat treated.

Once these values are determined, the value of FOM is calculated. The articles resulting from the heat treatment are examined microscopically to determine the thickness of the alpha case 34. The calculated value of FOM is associated with this alpha-case thickness.

Figure 5:
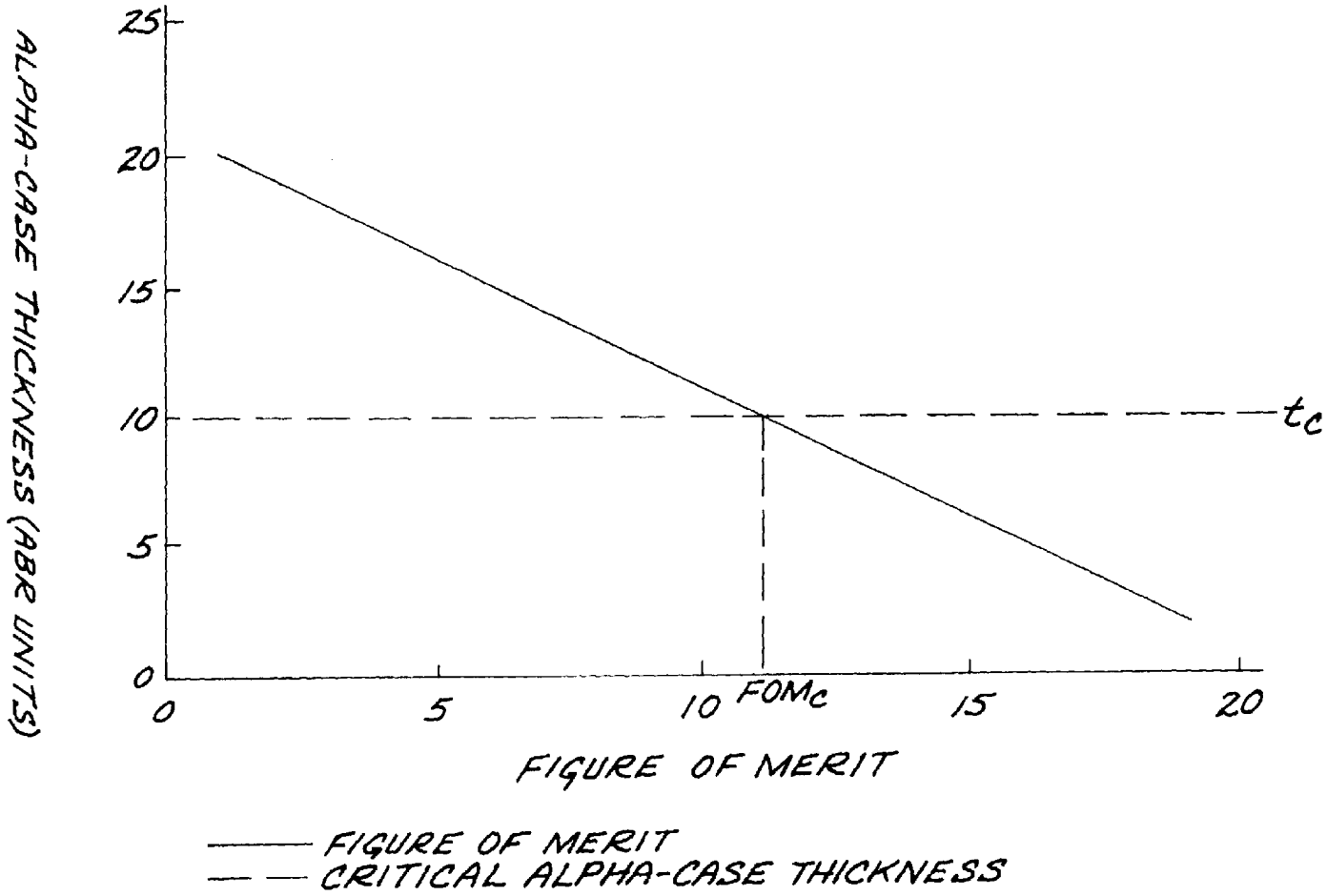
FIG. 5 is a schematic depiction of a typical relation between alpha-case thickness and FOM.

If the alpha-case thickness determined from a single test is exactly the maximum acceptable value, only the single test need be performed. More typically, a series of tests is performed and the resulting alpha-case thickness correlated with the determined value of FOM to obtain a line as shown in FIG. 5. (The relation is illustrated as linear in FIG. 5, but that need not be the case.) The critical FOM value, $FOM_C$, is determined as the intercept of the line with the horizontal line at $t_C$, the maximum thickness of the alpha case 34 that is tolerated. If FOM is less than $FOM_C$, the alpha case is thicker than $t_C$, and if FOM is less than $FOM_C$, the alpha case is thinner than $t_C$.

Next, there is a second determining, step 52, for a second set of titanium articles in a second vacuum furnace and for a second set of heat treatment conditions, a value of $A2_{Ti}$ for a relationship $$A2_{Ti}=1/K[FOM{\cdot}(RL2+VL2)-P2_{eff}],$$

wherein $A2_{T1}$ is a minimum permitted surface area of the second set of titanium articles, $P2_{eff}$ is an effective pumping rate, RL2 is a real leak rate, and VL2 is an outgassing leak rate. The values of FOM and K are those determined in the first determining step 50. The quantities RL2, VL2, and $P2_{eff}$ are measured as described above, except for the second furnace.

Thereafter, a third set of titanium articles is heat treated, step 54, in the second vacuum furnace and for the second set of heat treatment conditions. (The first set, second set, and third set of titanium articles are typically all of the same composition, but they may be different configurations and surface areas.) The surface area of the third set of titanium articles is not less than $A2_{Ti}$. If the surface area of the second set of titanium articles is less than $A2_{Ti}$, an excessive amount of oxygen is absorbed into the surfaces 32 per unit surface area, so that the thickness of the alpha case 34 is too great. Thus, the surface area of the articles to be heat treated in the step 54 must be not less than (i.e., equal to or greater than) $A2_{Ti}$.

There are many applications of the present approach. In one of most interest, heat treating studies of step 50 leading to the type of relation depicted in FIG. 5 are performed in a laboratory furnace, and the step 52 is performed in a production furnace different from the laboratory furnace. It is usually the situation that the laboratory furnace will be more readily available for performing the studies required in step 50 than is a production furnace. The studies of step 50 involve tests of each alloy type that is to be heat treated, and may require a large use of furnace time. The production furnace need only be taken from production briefly to measure $P2_{eff}$ and the sum (RL2+VL2). Further, the measured values of $P2_{eff}$ and the sum (RL2+VL2) are characteristics of the second vacuum furnace, and are applicable for any types and compositions of titanium articles that are later to be heat treated in the second vacuum furnace. The production furnace need be taken from production applications only a single time. Then using the calculational approach discussed above, the furnace-loading parameter may be determined for the production furnace.

In another but related type of application, if operating parameters leading to the curve of FIG. 5 have been determined in a first production furnace, the furnace-loading parameters of a second production furnace (such as a newly installed production furnace that is being calibrated for the same production operations being performed in the first production furnace) may be determined.

The present approach may be used to correlate results obtained in a single furnace, as for example where a new, improved pumping or sealing system is installed in an existing furnace. It may also be used to correlate the performance of different heat treatments performed in a single furnace, as where metallurgical considerations suggest that a heat treatment procedure be changed and there is concern whether the new heat treatment procedure will result in an acceptable alpha-case thickness.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for heat treating titanium-alloy articles, comprising the steps of:

first determining, for a first set of titanium articles in a first vacuum furnace and for a first set of heat treatment conditions, a minimum surface area of the first set of titanium articles associated with an acceptable alpha case formation for the first set of titanium articles;

second determining, for a second set of titanium articles in a second vacuum furnace and for a second set of heat treatment conditions, a minimum surface area of a second set of titanium articles associated with an acceptable alpha case formation for the second set of titanium articles, responsive to the value of the minimum surface area of the first set of titanium articles; and thereafter heat treating a third set of titanium articles in the second vacuum furnace and for the second set of heat treatment conditions, where the surface area of the third set of titanium articles is not less than the value of the minimum surface area of the second set of titanium articles.

2. The method of claim 1, wherein the second vacuum furnace is different from the first vacuum furnace.

3. The method of claim 1, wherein the first vacuum furnace is a first production vacuum furnace, and the second vacuum furnace is a second production vacuum furnace.

4. The method of claim 1, wherein the first vacuum furnace is a laboratory vacuum furnace, and the second vacuum furnace is a production vacuum furnace.

5. The method of claim 1, wherein the second set of heat treatment conditions is the same as the first set of heat treatment conditions.

6. The method of claim 1, wherein the step of first determining includes a step of utilizing a figure of merit to determine the minimum surface area of the first set of titanium articles, and wherein the step of second determining includes a step of utilizing the figure of merit to determine the minimum surface area of the second set of titanium articles.

7. The method of claim 6, wherein the steps of first determining and second determining utilize the figure of merit including is an effective pumping rate of a vacuum furnace, a surface area of the set of titanium articles, a real leak rate of the vacuum furnace, and an outgassing leak rate of the vacuum furnace.

8. The method of claim 6, wherein the steps of first determining and second determining utilize the figure of merit of the form $$FOM=(P_{eff}+K\cdot A_{Ti})/(RL+VL),$$

wherein FOM is a figure of merit value, $P_{eff}$ is an effective pumping rate of a vacuum furnace, $K\cdot A_{Ti}$ is a self-pumping rate of the set of titanium articles in the vacuum furnace, K is a self-pumping constant, A is a surface area of the set of titanium articles, RL is a real leak rate of the vacuum furnace, and VL is an outgassing leak rate of the vacuum furnace.

9. A method for heat treating titanium-alloy articles, comprising the steps of:

first determining, for a first set of titanium articles in a first vacuum furnace and for a first set of heat treatment conditions, a value of FOM associated with an acceptable alpha case formation for the first set of titanium articles, for a relationship $$FOM=(P1_{eff}+K\cdot A1_{Ti})/(RL1+VL1),$$

wherein $P_{eff}$ is an effective pumping rate, $K\cdot A1_{T1}$ is a self-pumping rate of a first set of titanium articles, K is a self-pumping constant, A1 is a surface area of the first set of titanium articles, RL1 is a real leak rate, and VL1 is an outgassing leak rate;

second determining, for a second set of titanium articles in a second vacuum furnace and for a second set of heat treatment conditions, a value of $A2_{T1}$ for a relationship $$A2_{Ti}=1/K[FOM\cdot(RL2+VL2)-P2_{eff}],$$

wherein $A2_{T1}$ is a minimum permitted surface area of the second set of titanium articles, $P2_{eff}$ is an effective pumping rate, RL2 is a real leak rate, and VL2 is an outgassing leak rate; and thereafter heat treating a third set of titanium articles in the second vacuum furnace and for the second set of heat treatment conditions, where the surface area of the third set of titanium articles is not less than $A2_{Ti}$.

10. The method of claim 9, wherein the second vacuum furnace is different from the first vacuum furnace.

11. The method of claim 9, wherein the second set of heat treatment conditions is the same as the first set of heat treatment conditions.

12. The method of claim 9, wherein the step of first determining includes the step of first measuring $P1_{eff}$, K, and a sum of RL1 and VL1.

13. The method of claim 9, wherein the step of second determining includes the step of second measuring $P2_{eff}$ and a sum of RL2 and VL2.

14. A method for heat treating titanium articles subject to the formation of alpha case, comprising the steps of:

selecting a figure of merit relationship with the heat treating of the titanium articles;

first determining, for a first set of titanium articles in a first furnace and for a first set of heat treatment conditions, a first-furnace set of parameters of the figure of merit relationship associated with a thickness of alpha case formation for the first set of titanium articles;

second determining, for a second set of titanium articles in a second furnace and for a second set of heat treatment conditions, a second-furnace set of parameters of the figure of merit relationship associated with an acceptable alpha case formation for the second set of titanium articles, responsive to the value of the first set of parameters; and thereafter heat treating a third set of titanium articles in the second vacuum furnace and for the second set of heat treatment conditions, responsive to the second-furnace set of parameters.

15. The method of claim 14, wherein the first furnace and the second furnace are vacuum furnaces.

16. The method of claim 14, wherein the second furnace is different from the first furnace.

17. The method of claim 14, wherein the second set of heat treatment conditions is the same as the first set of heat treatment conditions.

18. The method of claim 14, wherein the step of second determining includes a step of utilizing the figure of merit to determine a minimum surface area of the second set of titanium articles.

19. The method of claim 14, wherein the steps of first determining and second determining utilize the figure of merit relationship of the form $$FOM=(P_{eff}+K\cdot A_{Ti})/(RL+VL),$$

wherein FOM is a figure of merit value, $P_{eff}$ is an effective pumping rate of a vacuum furnace, $K\cdot A_{T1}$ is a self-pumping rate of a set of titanium articles in the vacuum furnace, K is a self-pumping constant, A is a surface area of the set of titanium articles, RL is a real leak rate of the vacuum furnace, and VL is an outgassing leak rate of the vacuum furnace.

* * * * *